US006452576B1

(12) United States Patent
Van Velzen et al.

(10) Patent No.: US 6,452,576 B1
(45) Date of Patent: Sep. 17, 2002

(54) ORGANIC ELECTROLUMINESCENT DISPLAY DEVICE

(75) Inventors: Jeroen Van Velzen; Coen T. H. F. Liedenbaum, both of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/489,751

(22) Filed: Jan. 21, 2000

(30) Foreign Application Priority Data

Jan. 21, 1999 (EP) ..... 99200181

(51) Int. Cl.[7] ..... G09G 3/32

(52) U.S. Cl. ..... 345/82; 345/74; 345/75; 345/76; 345/77; 345/78; 345/79; 345/80; 345/81; 345/83; 345/84; 345/695; 315/169.3; 340/825.82

(58) Field of Search ..... 345/77, 82, 76, 345/74, 75, 78, 79, 80, 81, 83, 84, 695; 315/169.3; 340/825.82

(56) References Cited

U.S. PATENT DOCUMENTS 5,689,322 A * 11/1997 Hirata et al. ..... 349/180
6,014,119 A * 1/2000 Staring et al. ..... 345/82
6,144,165 A * 11/2000 Liedenbaum ..... 315/169.3

FOREIGN PATENT DOCUMENTS

WO WO9636959 11/1996 ..... G09G/3/30

* cited by examiner

*Primary Examiner*—Richard Hjerpe
*Assistant Examiner*—Jean Lesperance
(74) *Attorney, Agent, or Firm*—Aaron Waxler

(57) ABSTRACT

Electroluminescent display device comprising drive circuitry (a number of alternatives is given) to determine the surface area of a pixel (via capacitance, reverse current) and adjust the current density in the pixel accordingly.

10 Claims, 4 Drawing Sheets

ORGANIC ELECTROLUMINESCENT DISPLAY DEVICE

BACKGROUND OF THE INVENTION

The invention relates to an electroluminescent display device comprising a layer of electroluminescent material with an active layer of an organic material, which layer is present between a first and a second pattern of electrodes, which patterns define pixels having a different surface area, at least one of the two patterns being transparent to light to be emitted through the active layer, and a first pattern comprising a material which is suitable for injecting charge carriers by means of a bias current for emitting, the display device comprising drive means for adjusting the bias current of a pixel.

Electroluminescent (EL) display devices may be used in, for example, displays and indicator lamps. An increasing number of organic materials such as, for example, semiconducting organic polymers is used for the active layer in such structures. This increases the number of possible materials for use in these types of display devices. The active layer and the two electrode layers (the electroluminescent display device) preferably comprise a plurality of LEDs, for example, in the form of light-emitting surfaces arranged as segments or matrices, as intended for a display device described in, for example, WO 96/36959 (PHN 15.320), or combinations thereof.

The operation is based on the recombinations of electron hole pairs which are injected into the semiconductor material (during use in the forward direction) from electrodes situated on both sides of the active layer. Due to these recombinations, energy is released in the form of (visible) light, a phenomenon referred to as electroluminescence. The wavelength and hence the color of the emitted light is also determined by the bandgap of the (semiconductor) material.

Notably when using these types of display devices with pixels having a different area, problems arise in realizing the desired brightness at a given signal. The input signal is generally used for controlling a current source which generates a current through the LED (the pixel). The brightness (luminance) of such a pixel is, however, dependent on the density of the current through such a pixel. When using the same current through LEDs with a different surface area, a difference in surface area leads to a difference in the current density and hence to a difference in luminance.

OBJECTS AND SUMMARY OF THE INVENTION

It is, inter alia, an object of the present invention to obviate one or more of the above-mentioned drawbacks.

To this end, a luminescent display device according to the invention is characterized in that the drive means comprise means for varying the current density of the bias current in dependence upon a surface area of a pixel.

The invention is based on the recognition that different electrical parameters (capacitance, current density) are dependent on the surface area of a pixel and may therefore be used as feedback parameters for adjusting the correct bias current.

A preferred embodiment of a luminescent display device according to the invention is therefore characterized in that the drive means comprise means for defining the capacitance of a pixel.

This may be realized in a simple manner by means of a (small-signal) alternating current. A first embodiment is therefore characterized in that the means for defining the capacitance of a pixel comprise means for adding a (small-signal) alternating current to the bias current of the pixel and for measuring the associated (small-signal) alternating voltage.

In addition, the capacitance of a pixel may be defined by means of, for example, a sample-and-hold method, in which a pixel (segment) is supplied with a fixed measuring current and the voltage caused by the measuring current across the pixel is fixed. The measuring current is preferably supplied within a measuring period in which the voltage across the pixel remains limited to a value below the threshold value of the pixel.

The means for defining the capacitance of a pixel may alternatively comprise means for applying a voltage pulse across a pixel and for defining the decay time of the current through the pixel. The measured decay time is then compared, for example, with the decay time of a reference circuit.

Another possibility of defining the capacitance of a pixel makes use of the resonance frequency of a circuit of which the pixel forms part.

Another embodiment of a luminescent display device according to the invention makes use of current measurement. This embodiment is characterized in that the electroluminescent display device comprises at least two pixels having a different surface area, and drive unit means for applying a voltage in the reverse direction across the pixels, and means for defining the reverse current. This embodiment is notably, but not exclusively, suitable for a luminescent display device driven in a multiplex mode.

These and other aspects of the invention are apparent from and will be elucidated with reference to the embodiments described hereinafter.

BRIEF DESCRIPTION OF THE DRAWINGS

In the drawings:

FIG. 6 shows diagrammatically a pixel with a part of another measuring circuit, while

The Figures are diagrammatic and not drawn to scale. Corresponding elements are generally denoted by the same reference numerals.

DESCRIPTION OF THE PREFERRED EMBODIMENTS

Figure 1:
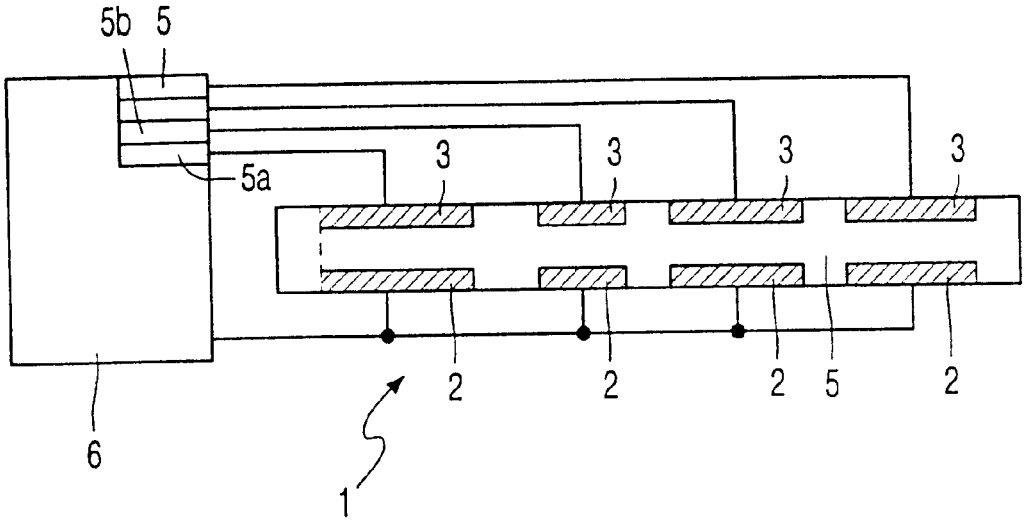
FIG. 1 is a diagrammatic cross-section of a part of a display device to which the invention is applicable.

FIG. 1 shows a display device 1 with an active layer 5 between two patterns of electrode layers 2, 3 of electrically conducting materials. In this example, the electrodes 2 with the electrodes 3 and the interpositioned active material define light-emitting diodes (LEDs) 4, also referred to as pixels. At least one of the electrode patterns is transparent to the emitted light in the active layer. During operation, the electrodes 2 are driven in such a way that they have a sufficiently positive voltage with respect to the electrodes 3 for the injection of holes into the active layer. The material of these electrodes 2 has a high work function and is usually constituted by a layer of indium oxide or indium-tin oxide (ITO). Particularly ITO is suitable due to its satisfactory electric conductivity and high transparency. The electrodes 3 serve as negative electrodes (with respect to the electrodes 2) for the injection of electrons into the active layer. In this example, the material for this layer is aluminum.

The light intensity of the LED (the pixel) 4 depends on the current density. The pixels 4 are driven in this example by means of diagrammatically shown current sources 5 which are integrated in the drive unit 6. At an equal luminance of, for example, the pixels $\mathbf{4}^a$ and $\mathbf{4}^b$ and without special measures, the current sources $\mathbf{5}^a$, $\mathbf{5}^b$ will supply the same current. Since pixel $\mathbf{4}^a$ has a larger surface area than pixel $\mathbf{4}^b$, the density of the current through pixel $\mathbf{4}^a$ will be smaller than the density of the current through pixel $\mathbf{4}^b$. To preclude adjustment of the drive unit 6 for each and every different combination of pixels, it is provided, in accordance with the invention, with means for defining the surface area of the pixels to be driven, so that, during operation, a current density can be adapted to the surface area of a pixel to be driven.

In a first variant, the current supplied by the driver implemented as current source 5 is modulated around the adjusting point by means of an AC source 7. The AC current has such a low amplitude i that the adjusting point of the current/voltage characteristic associated with the LED 4 does not change or hardly changes so that the differential resistance $r_d$ does not change. Simultaneously, the associated small-signal AC voltage u is measured in the drive unit 6. For the current i it holds that $$i = u \cdot \left( \frac{1 + j\omega C r_d}{r_d} \right)$$

Figure 3:
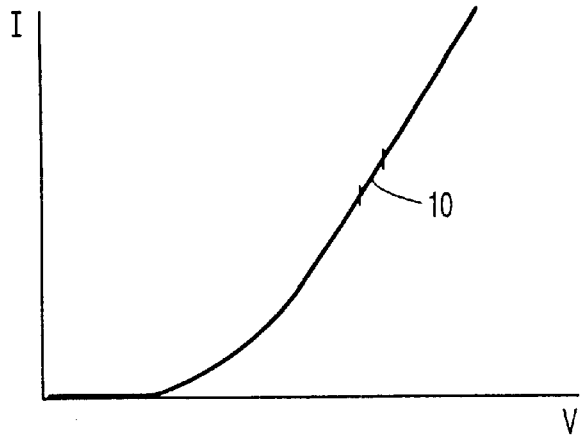
FIG. 3 shows the current/voltage characteristic of a LED.

Here, $r_d$ is the differential resistance at, for example, the point 10 (FIG. 3) of the current/voltage characteristic of the LED 4. For high frequencies ($\omega >> Cr_d$) it holds that $i = u.j\omega C$ or $u. = -ji/\omega C$.

Figure 2:
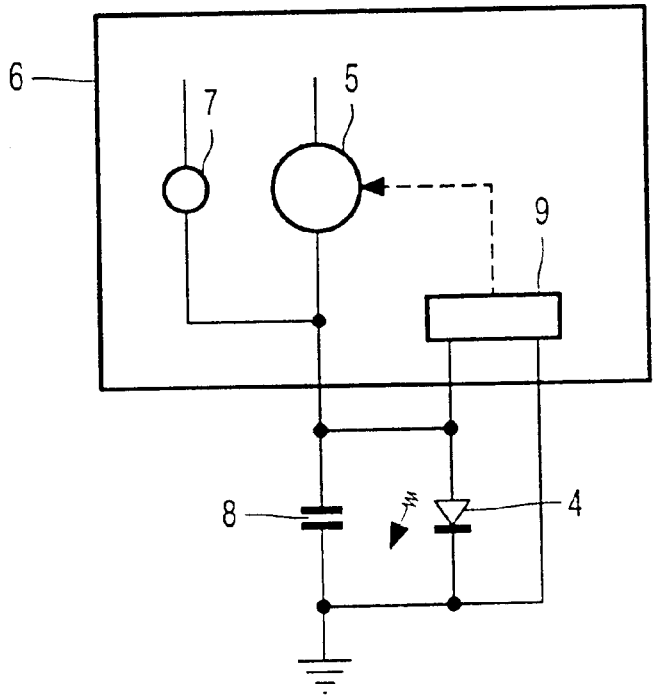
FIG. 2 shows diagrammatically a pixel and a part of the associated measuring circuit.

By modulating the current source 5 with a small-signal AC current i, the amplitude u of the AC voltage generated thereby can be measured, for example, with a high-ohmic volt meter 9 which is integrated in the drive unit 6. For the measured voltage, it now holds that this is inversely proportional to the capacitance of the LED 4 (diagrammatically shown in FIG. 2 by means of the capacitor 8). ($u = -ji/\omega C$). The desired current density is then adjusted in the drive unit 6 with reference to the measured voltage.

Figure 4:
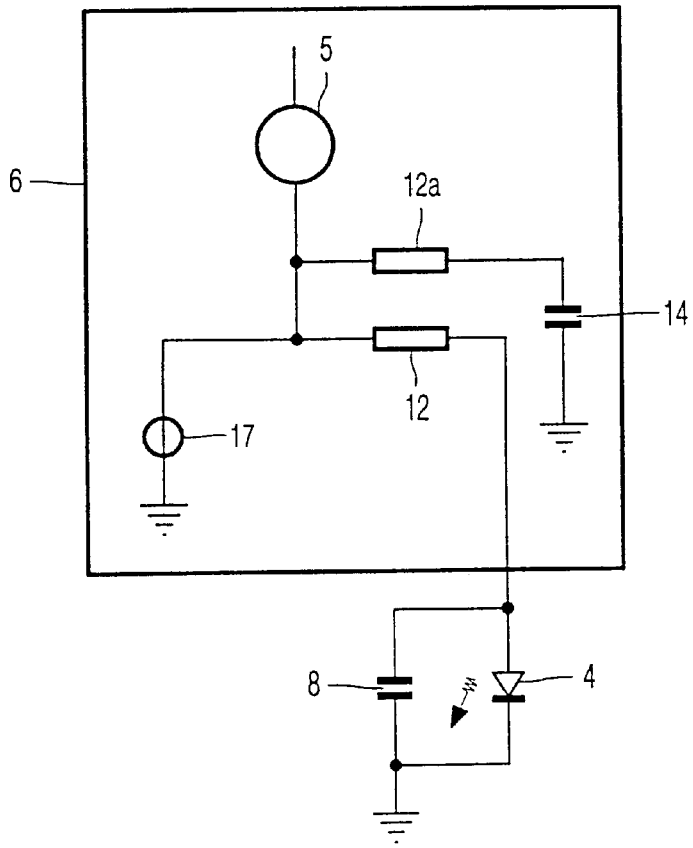
FIG. 4 shows diagrammatically a pixel with a part of another measuring circuit.
Figure 5:
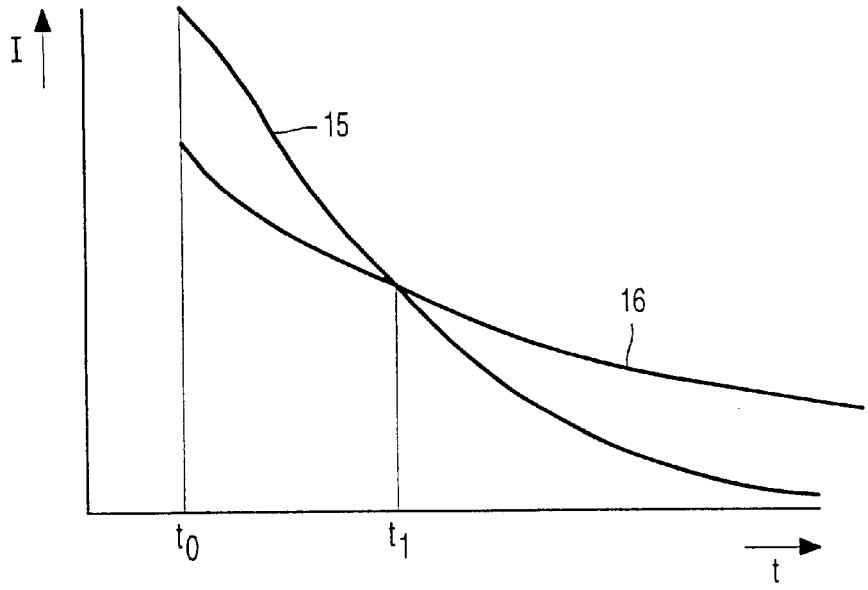
FIG. 5 shows the current-time behavior in the circuit of FIG. 4 for pixels having a different surface area.

In the embodiment of FIG. 4, the delay time is measured of an RC network in which the LED 4 and the associated capacitor 8 are incorporated. Via a switch 11, a resistor 12 is incorporated in the current path and the delay time (RC time) is measured. The delay time is determined, for example, by comparing the current through a pixel with that of a comparison circuit comprising a resistor $\mathbf{12}^a$ having the same resistance as the resistor 12, and a reference capacitor 14. The pixel and the comparison circuit are, for example, driven simultaneously with an identical voltage pulse (generated via a voltage source 17), while the current source 5 is switched off. For example, the instant $t_1$ can then be determined, at which instant the current through the LED 4 (curve 15 in FIG. 5) is identical to the current through the reference capacitor 14 (curve 16 in FIG. 5). These currents may be measured, for example, via the voltage across the resistors 15 by means of high-ohmic volt meters (not shown) in the drive unit 6.

Figure 6:
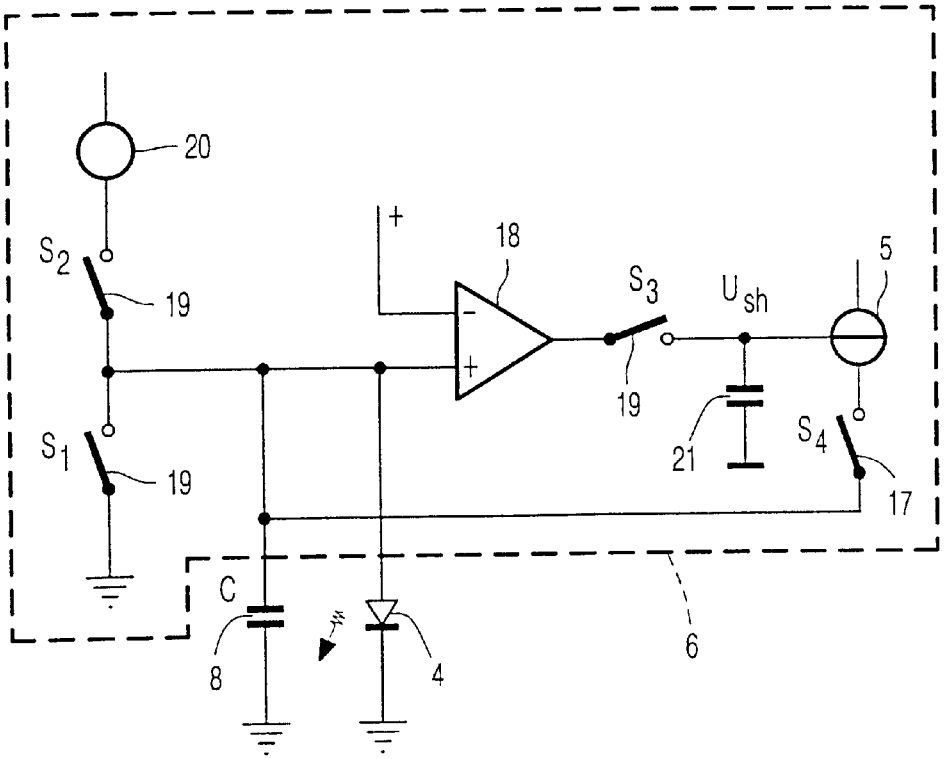
Figure 7:
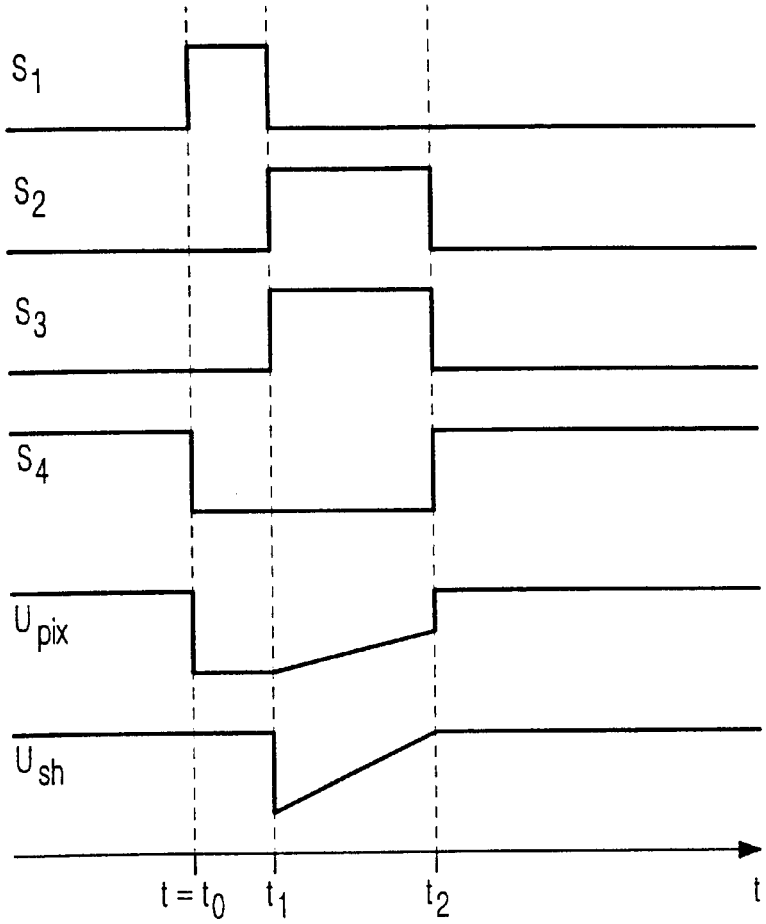
FIG. 7 shows the switching patterns and some voltages associated with the circuit of FIG. 6.

FIGS. 6 and 7 show how a difference in capacitance and hence surface area can be defined with a sample-and-hold circuit which is added to the current source 5. In this example, this circuit comprises four switches 19($s_1$, $s_2$, $s_3$, $s_4$), an operational amplifier 18 and an auxiliary current source 20 and a capacitor 21 (see FIG. 6). The pixel, represented by the LED 4 and the capacitor 8, can be connected to the current source 5 via the switch $S_4$ and is connected at the other end to the non-inverting input of the operational amplifier 18, which input can be connected to ground or to the auxiliary current source 20, dependent on the position of the switches $s_1$, $s_2$. The inverting input of the operational amplifier 18 is connected to a positive voltage. Its output can be connected to the capacitor 21 via the switch $s_3$. The voltage across this capacitor ($U_{sh}$) defines the current through the current source 5 ($I = k.U_{sh}$). Possible non-linearities of the capacitance may be processed in k as a function of the voltage. This notably applies to smaller capacitances.

FIG. 7 shows the behavior as a function of time (the position of the switches, as well as the voltages $U_{sh}$ and $U_{pix}$, the voltage across the pixel). At the instant $t = t_0$, switch $s_1$ is closed and switch $s_4$ is opened. The pixel 4 is, as it were, short-circuited thereby (reset) and $U_{pix}$ becomes 0 volt. At the instant $t = t_1$, switch $s_1$ is opened while the switches $s_2$, $s_3$ are closed. Due to a constant (measuring) current supplied by the auxiliary current source 20, the voltage across the pixel (segment) increases linearly in accordance with $$dV = \frac{I(t) \cdot dt}{C}.$$

The measuring time (the period $t_{1-t2}$) is chosen to be sufficiently small to cause the LED 4 not to convey current ($U_{pix}$ remains below the threshold voltage). Via the operational amplifier, a voltage $U_{sh}$ is obtained at the capacitor 21, which voltage is higher when $t = t_2$, as $U_{pix}$ is higher (hence C is smaller). At the instant $t_2$, the switches $s_2$, $s_3$ are opened again. The voltage $U_{sh}$ across the capacitor 21 is thereby fixed. Simultaneously, the switch $s_4$ is closed. The voltage $U_{sh}$ directly influences the current of the current source 5 and hence the density of the current through the LED 4.

Figure 8:
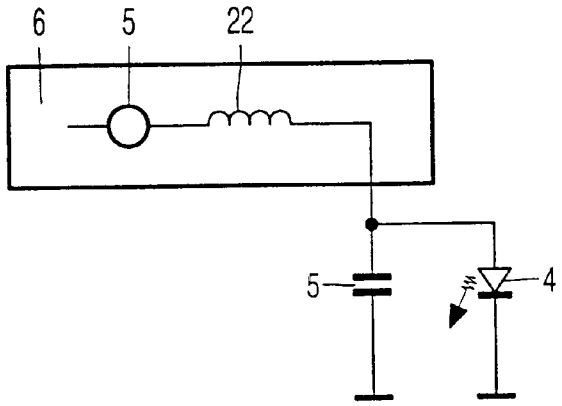
FIG. 8 shows diagrammatically a pixel with a part of another measuring circuit.

The device of FIG. 8 makes use of a current source 5 whose operating frequency may be varied. A coil 22 with an inductance L is arranged in the drive unit 6 between the current source 5 and the LED 4. To define the capacitance (and hence the surface area) of the pixel, the operating frequency is varied until resonance occurs. The value of C is derived again from the resonance frequency $\omega = 1/\sqrt{(LC)}$, of course after correction of capacitances in the measuring circuit.

Another value which is dependent on the surface area of the LED is the reverse current or $I_{rev}$. To be able to measure this value, at least two LEDs should be driven by the same current source. In contrast to the previous embodiments, which are based on the use of one current source per LED, this embodiment is suitable for multiplex applications.

To this end, the electroluminescent elements are driven in this embodiment by the same current source by means of multiplexing. In this mode, a zero voltage is applied between the electrodes 2 and 3 of one of the LEDs associated with the current source, while a reverse voltage $-V_b$ is applied across the other LEDs and the current thus generated is measured. The measured current value is, for example, digitized in the drive unit 6. The values found are subsequently used for computing the densities of the currents to be adjusted, which currents must flow through each electroluminescent element (the LEDs) to obtain a uniform luminance. In the case of 1:4 multiplexing, it holds for the four current measurements ($I_1$ of the first measurement, $I_2$ of the second measurement, etc.) for the measured reverse current $I_{rev}$:

$$I_1=I_{rev2}+I_{rev3}+I_{rev4}$$

$$I_2=I_{rev1}+I_{rev3}+I_{rev4}$$

$$I_3=I_{rev1}+I_{rev2}+I_{rev4}$$

$$I_4=I_{rev1}+I_{rev2}+I_{rev3}$$

or:

$$I_{rev1}=1/3(I_1+I_3+I_4-2I_2)$$

$$I_{rev2}=1/3(I_1+I_2+I_4-2I_3)$$

$$I_{rev3}=1/3(I_2+I_3+I_4-2I_1)$$

$$I_{rev1}=1/3(I_1+I_2+I_3-2I_4)$$

In the drive unit 6, the adaptation thus found is measured either during operation and, if necessary, corrected, or is realized in advance with the aid of a look-up table. The measurement preferably takes place by using a current source 4 (multiplexing), but is alternatively possible via separate current sources 4.

In summary, the invention provides a plurality of circuits for an electroluminescent display device so as to define the surface area of a pixel (capacitively or via current measurement) and to adapt the density of the current through the pixel on the basis of the measuring result.

The invention relates to each and every novel characteristic feature and each and every combination of characteristic features.

What is claimed is:

1. An electroluminescent display device comprising a layer of electroluminescent material with an active layer of an organic material, which layer is present between a first and a second pattern of electrodes, which patterns define pixels having a different surface area, at least one of the two patterns being transparent to light to be emitted through the active layer, and said first pattern comprising a material which is suitable for injecting charge carriers by means of a bias current for emitting, the display device comprising drive means for adjusting the bias current of a pixel, characterized in that the drive means comprise means for varying the current density of the bias current in dependence upon a surface area of a pixel.

2. An electroluminescent display device as claimed in claim 1, characterized in that the drive means comprise means for defining the capacitance of a pixel.

3. An electroluminescent display device as claimed in claim 2, characterized in that the means for defining the capacitance of a pixel comprise means for adding an alternating current to the bias current of the pixel and for measuring the associated AC voltage.

4. An electroluminescent display device as claimed in claim 2, characterized in that the means for defining the capacitance of a pixel comprise means for supplying a pixel with a fixed measuring current, and means for fixing the voltage caused by the measuring current across the pixel.

5. An electroluminescent display device as claimed in claim 4, characterized in that the means for supplying a pixel with a fixed measuring current limit the voltage across the pixel within a measuring period to a value below the threshold voltage of the pixel.

6. An electroluminescent display device as claimed in claim 2, characterized in that the means for defining the capacitance of a pixel comprise means for applying a voltage pulse across a pixel and for defining the decay time of the current through the pixel.

7. An electroluminescent display device as claimed in claim 6, characterized in that the decay time is compared with the decay time of a reference circuit.

8. An electroluminescent display device as claimed in claim 2, characterized in that the means for defining the capacitance of a pixel comprise means for defining the resonance frequency of a circuit of which the pixel forms part.

9. An electroluminescent display device as claimed in claim 1, characterized in that the electroluminescent display device comprises at least four pixels having a different surface area, and drive unit means for applying a voltage in the reverse direction across the pixels, and means for defining the reverse current.

10. An electroluminescent display device as claimed in claim 9, characterized in that the electroluminescent display device comprises a drive circuit for multiplexing at least two pixels.

* * * * *